US006142828A

United States Patent [19]

Pepe

[11] Patent Number: 6,142,828

[45] Date of Patent: Nov. 7, 2000

[54] SHIELDED CONNECTOR HAVING ADJUSTABLE CABLE EXIT

[75] Inventor: Paul J. Pepe, Winston-Salem, N.C.

[73] Assignee: The Whitaker Corporation, Wilmington, Del.

[21] Appl. No.: 09/199,614

[22] Filed: Nov. 24, 1998

[51] Int. Cl.[7] ..... H01R 13/648

[52] U.S. Cl. ..... 439/610; 439/607

[58] Field of Search ..... 439/607, 608, 439/609, 610, 676, 98, 471, 585

[56] References Cited

U.S. PATENT DOCUMENTS

| | | | |
|---|---|---|---|
| 4,713,023 | 12/1987 | Bixler et al. | 439/393 |
| 5,378,172 | 1/1995 | Roberts | 439/607 |
| 5,496,195 | 3/1996 | Reed | 439/607 |
| 5,733,146 | 3/1998 | Block | 439/610 |

OTHER PUBLICATIONS

AMP Instruction Sheet 408–3354, AMP 110Connect Panel Mount Jacks (Category 3 and 5), Rev. A, 3 pages; Dec. 1995; AMP Incorporated, Harrisburg, PA.

*Primary Examiner*—Brian Sircus
*Assistant Examiner*—Son V. Nguyen
*Attorney, Agent, or Firm*—Robert Kapalka

[57] ABSTRACT

A shielded electrical connector for use with a cable (2) having a wire conductor (4) within a ground sheath (6) includes an interconnection device (10) having a front mating end (12) and a rear cable-connecting end (14). A conductive shield (20) is disposed on the interconnection device. The shield is manufactured as a one-piece metallic member having multiple panels (40, 50, 60, 70, 80) disposed in respective different planes around the interconnection device. The shield also has fingers (90) disposed at the cable-connecting end of the interconnection device. The fingers are circumferentially spaced-apart to define a cable exit (25) between the fingers. The fingers extend rearwardly to respective finger contact portions (92) which are arranged for engaging the ground sheath (6) when the cable is disposed in the cable exit.

9 Claims, 4 Drawing Sheets

SHIELDED CONNECTOR HAVING ADJUSTABLE CABLE EXIT

FIELD OF THE INVENTION

The invention relates to an electrical connector having an exterior metal shield, and in particular, to a portion of the shield which is adapted for engaging a ground sheath of a cable that is terminated in the connector.

BACKGROUND OF THE INVENTION

A panel mount modular jack electrical connector which is sold by AMP Incorporated of Harrisburg, Pa. under part number 569015 includes an exterior metal shield which serves to block electromagnetic interference (EMI) which may be emitted by, or may impinge on, the connector. The shield comprises a three-piece metal shell including a front shield, a top shield, and a bottom shield which substantially surround the connector. The bottom shield includes a ground clip for engaging a ground sheath in the form of a metal foil or braid that typically surrounds the wires in a communications cable. The ground clip has the form of a channel which can receive the cable, and opposed arms which can be crimped by a tool into engagement with the cable ground sheath.

This shield has the drawback that it is formed as three separate pieces that must be individually manufactured and handled prior to application to the connector. Another problem with the shield is that the ground clip works best with one particular cable size, and the ground clip does not accommodate a range of standard cable sizes. Further, the ground clip may not engage the cable ground sheath with sufficient pressure for optimum electrical performance.

There is a need for a shielded electrical connector which overcomes these problems.

SUMMARY OF THE INVENTION

The invention is a shielded electrical connector for use with a cable having a wire conductor within a ground sheath. The electrical connector comprises an interconnection device having a front mating end and a rear cable-connecting end, and a conductive shield disposed on the interconnection device. The shield comprises a one-piece metallic member having multiple panels disposed in respective different planes around the interconnection device, and fingers disposed at the cable-connecting end of the interconnection device. The fingers are circumferentially spaced-apart to define a cable exit between the fingers. The fingers extend rearwardly to respective finger contact portions which are arranged for engaging the ground sheath when the cable is disposed in the cable exit.

BRIEF DESCRIPTION OF THE DRAWINGS

The invention will now be described by way of example with reference to the accompanying drawings wherein.

DETAILED DESCRIPTION OF A PREFERRED EMBODIMENT

Figure 1:
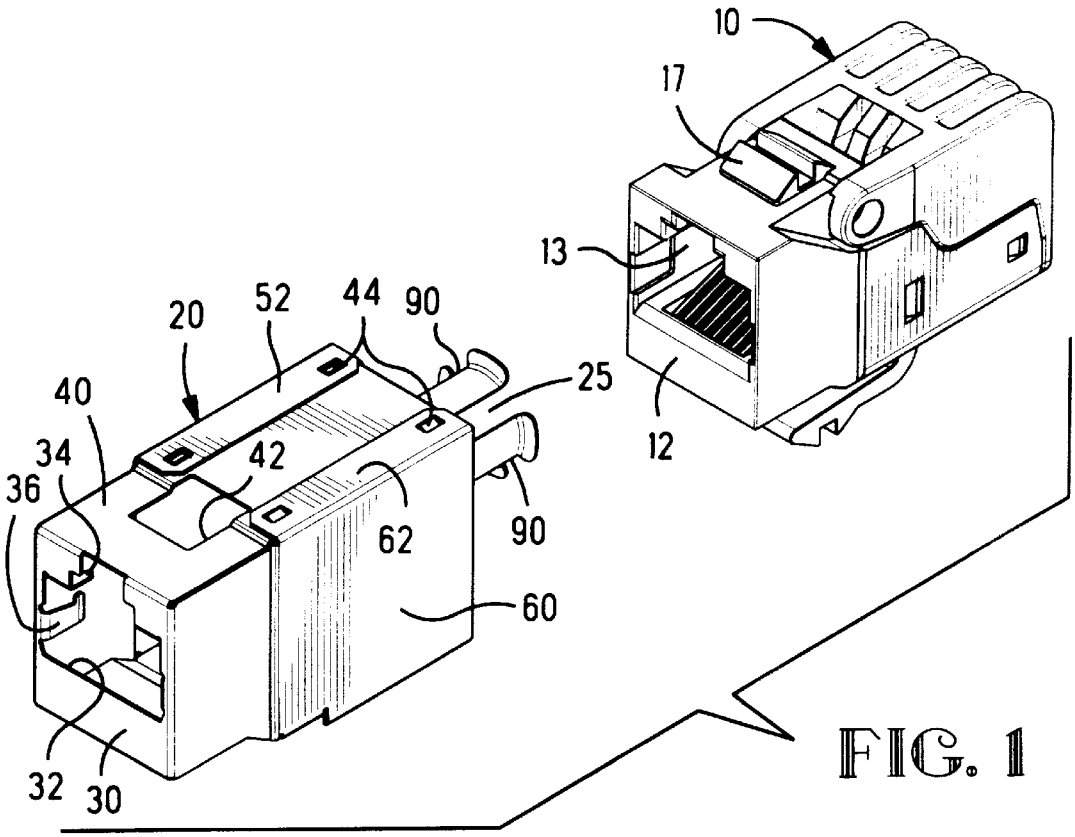
FIG. 1 is a top front isometric view of a shield and an electrical interconnection device which comprise a shielded electrical connector according to the invention.
Figure 2:
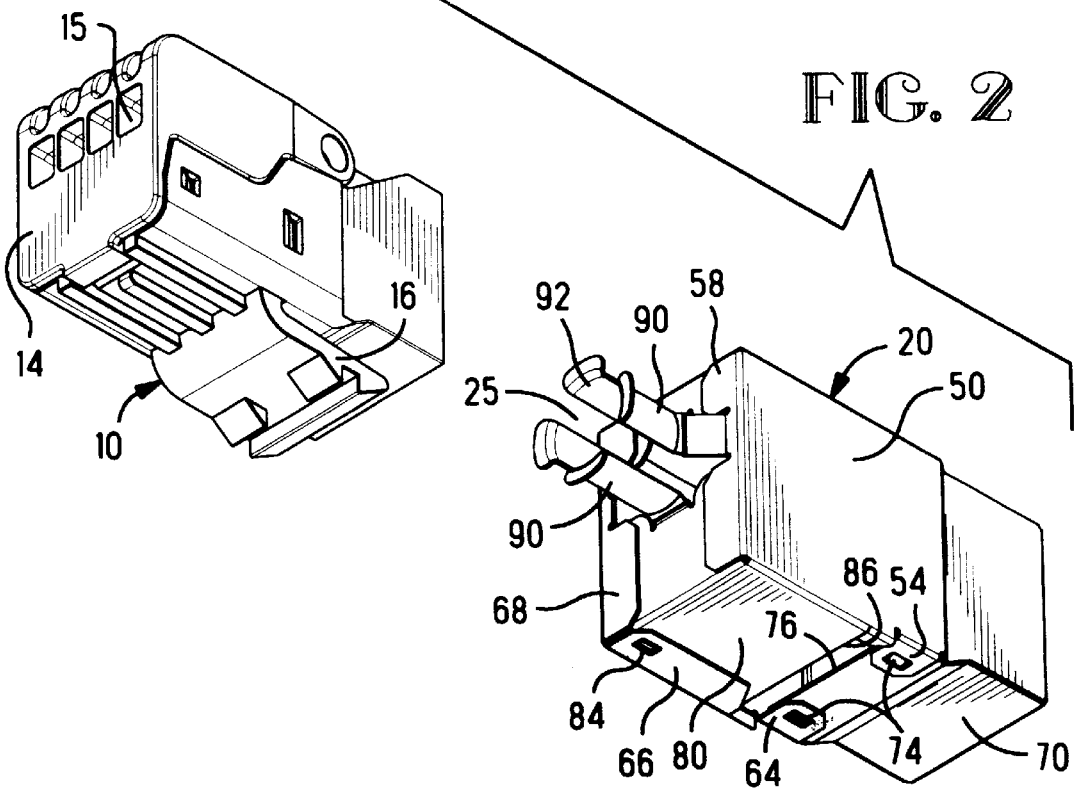
FIG. 2 is a bottom rear isometric view of the shield and electrical interconnection device.

A shielded electrical connector according to the invention as shown in exploded views in FIGS. 1 and 2 comprises an electrical interconnection device 10 and a conductive shell or shield 20. The interconnection device 10 in the present example is of a type commonly known as a panel mount modular jack connector. However, it should be understood that a shielded connector according to the invention may embody numerous other types of electrical interconnection devices including plug-type connectors.

The interconnection device 10 has a front mating face 12 and a rear cable-connecting end 14. The mating face 12 has a cavity 13 which is configured for receiving a mating modular plug connector (not shown). The cable-connecting end 14 has four passages 15 which are configured to receive pairs of twisted wires from a communications cable. The interconnection device has a latch arm 16 and a latch tab 17 which are configured to cooperate with edges of a cutout in a mounting panel (not shown) to secure the interconnection device in the mounting panel. Further details of the interconnection device 10 are disclosed in U.S. patent application Ser. No. 09/162,516 filed Sep. 29, 1998, which application has the same assignee as the present application and is incorporated by reference as if set forth fully herein.

Figure 4:
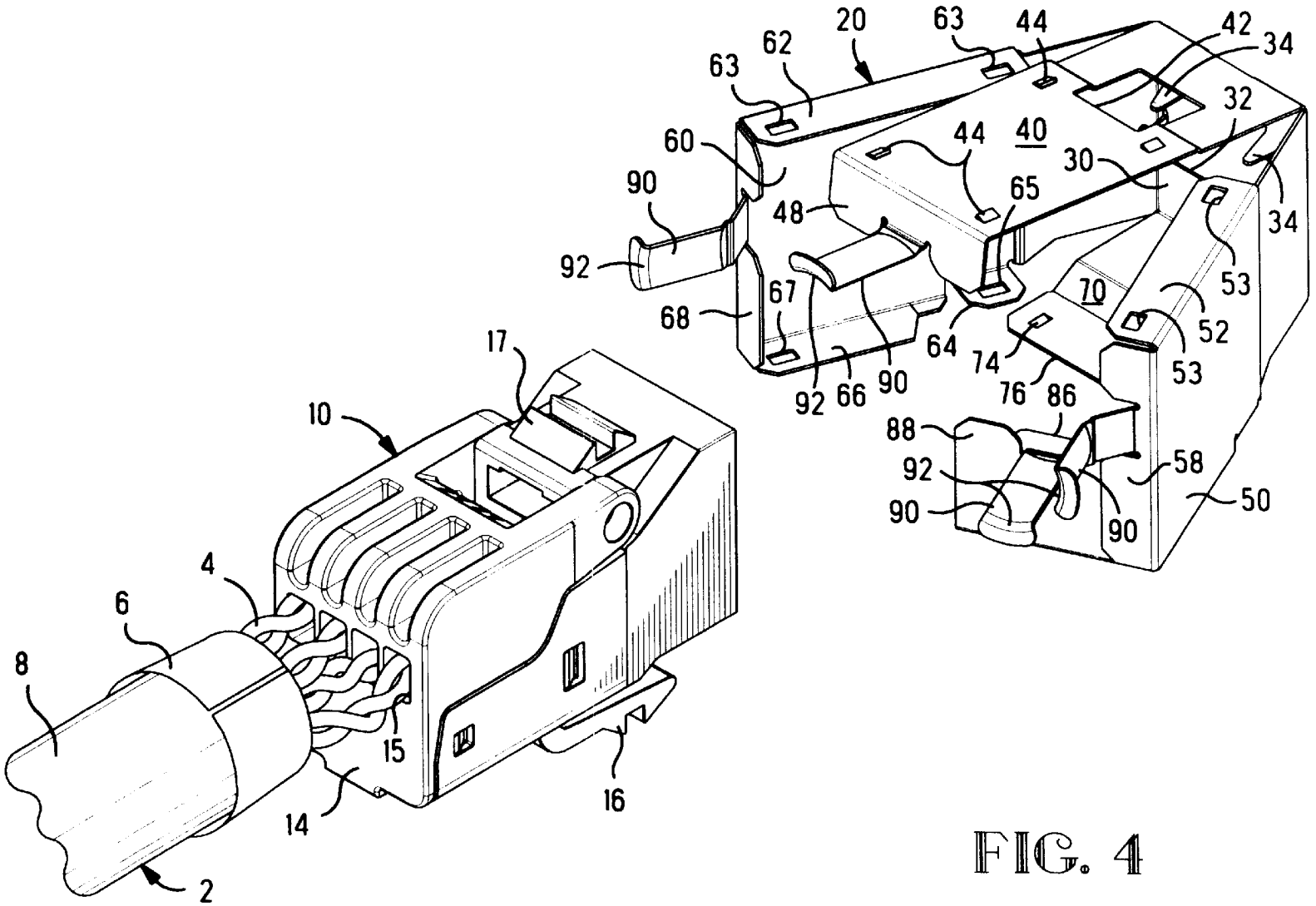
FIG. 4 is an isometric view of the blank member partially formed as the shield and poised for application to the interconnection device which is terminated to a cable.

FIG. 4 shows a typical communications cable 2 which is terminated to the interconnection device 10. The communications cable 2 includes a number of wire conductors 4 which are twisted together as pairs, and these wire pairs are received in the passages 15 and electrically terminated in the interconnection device. The wire conductors 4 are enclosed within a ground sheath 6 and an insulation jacket 8. Prior to insertion of the wire conductors 4 in the passages 15, an end portion of the insulation jacket 8 is removed from the cable 2 and the ground sheath 6 is folded back over the cable so that the ground sheath is exposed at an end of the cable.

Figure 3:
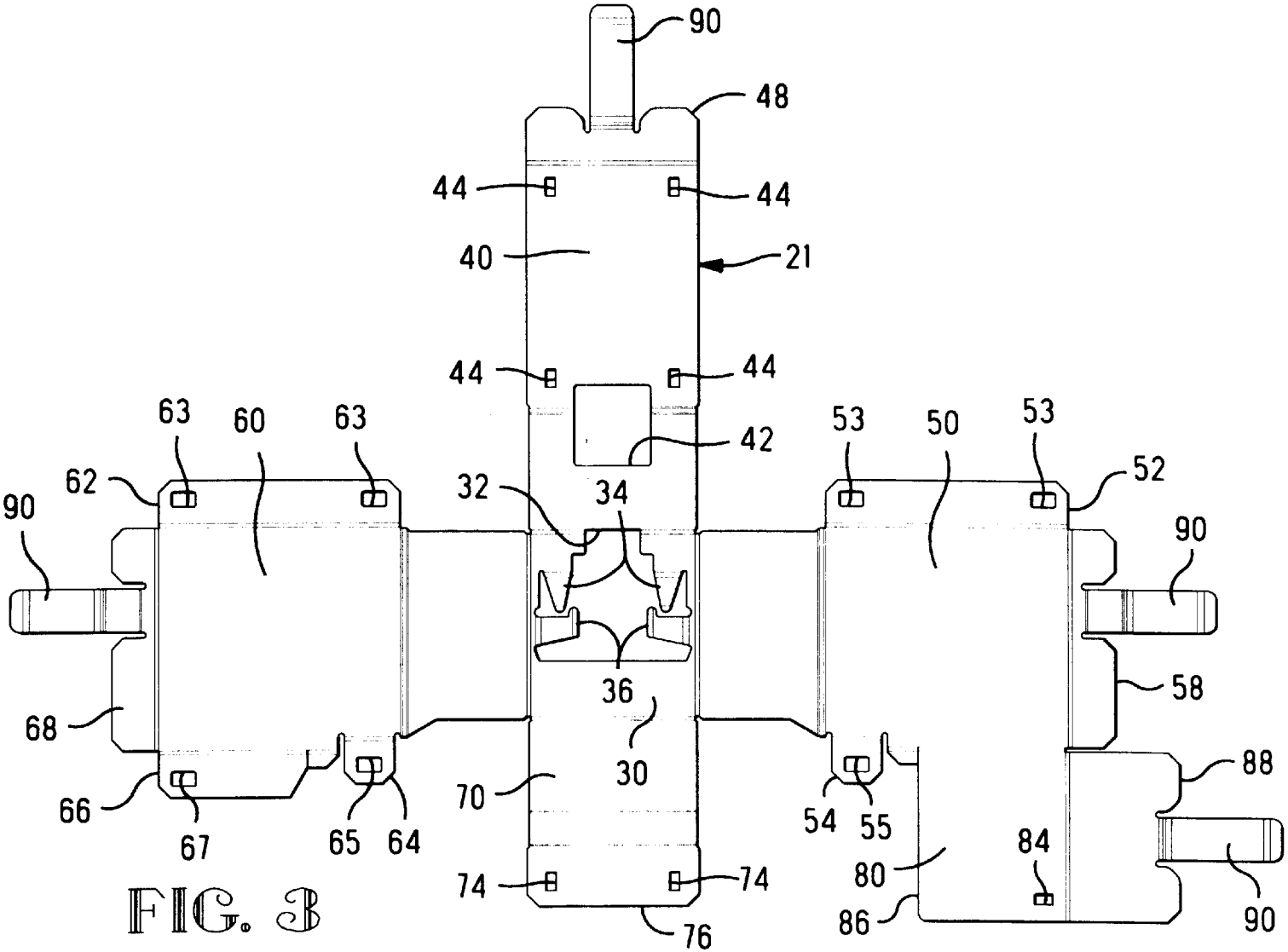
FIG. 3 is a plan view of a blanked member prior to being formed as a shield.
Figure 5:
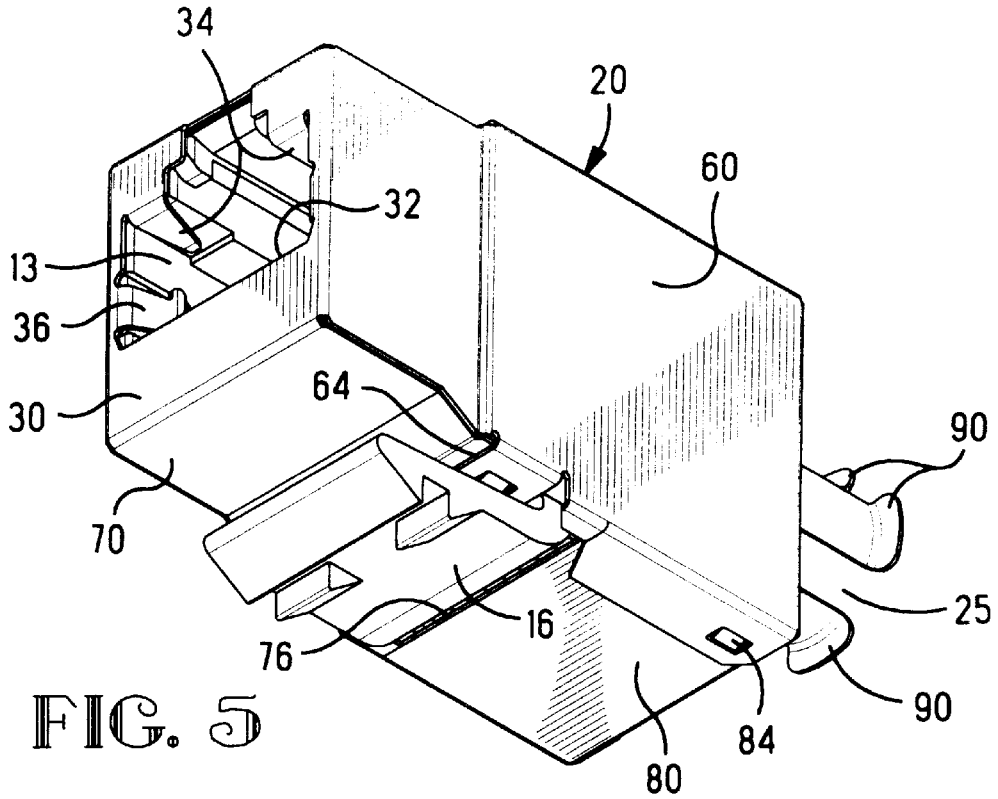
FIG. 5 is a bottom front isometric view of the shielded electrical connector.
Figure 6:
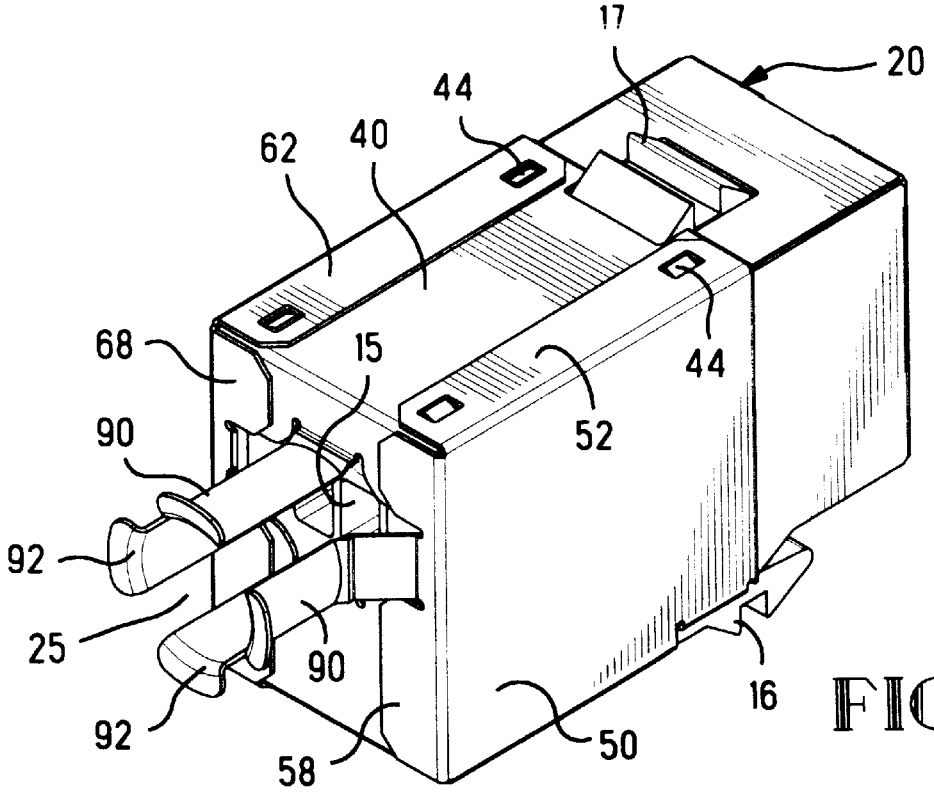
FIG. 6 is a top rear isometric view of the shielded electrical connector.

The shield 20 is a one-piece member which is preferably stamped and formed from metal sheet material. FIG. 3 shows a planar one-piece shield blank 21 after it has been stamped from sheet material but prior to being formed. The shield 20 is formed by bending the shield blank 21 at appropriate locations to provide multiple panels which are disposed in respective different planes, as shown in FIG. 4. The shield 20 is wrapped around the interconnection device 10 so that it substantially surrounds the interconnection device, as shown in FIGS. 5 and 6. It should be understood that the shield blank 21 need not be formed to the configuration of shield 20 with simultaneous bending operations, but instead may be formed with a number of successive bending operations.

The stamped and formed shield 20 has multiple panels including a front panel 30, a top panel 40, a first side panel 50, a second side panel 60, a forward bottom panel 70, and a rearward bottom panel 80. The front panel 30 is disposed along the mating face 12 of the interconnection device, and the front panel has a window 32 which is in registration with the cavity 13. The shield has lock tabs 34 and ground tabs 36 which are connected to the front panel 30. The lock tabs 34 are bent into the cavity 13 so as to grip a wall of the cavity and thereby help to secure the shield 20 to the interconnection device. The ground tabs 36 are bent into the cavity and are arranged for engaging a shield of a mating connector (not shown) that is received in the cavity.

The top panel 40 extends rearwardly from the front panel 30 over a top of the interconnection device. The top panel has a cutout 42 which enables the latch tab 17 of the interconnection device to protrude through the shield. The top panel has lances 44 which extend out of a plane of the top panel.

The forward bottom panel 70 extends rearwardly from the front panel 30 along a bottom of the interconnection device. The forward bottom panel has lances 74 which extend out of a plane of the forward bottom panel. The forward bottom panel has a rearward edge 76 which is disposed in a vicinity of the latch arm 16 of the interconnection device.

The first side panel 50 and the second side panel 60 extend rearwardly from the front panel 30 along respective opposite sides of the interconnection device. Each of the side panels 50, 60 has a top flap 52, 62 which overlies the top panel 40 of the shield, and a forward bottom flap 54, 64 which overlies the forward bottom panel 70 of the shield. The top flaps 52, 62 have apertures 53, 63 which receive the lances 44 of the top panel, and the forward bottom flaps 54, 64 have apertures 55, 65 which receive the lances 74 of the forward bottom panel. The multiple panels of the shield are held in a closed position around the interconnection device by interlocking engagement of the lances in the apertures.

The rearward bottom panel 80 is connected to the first side panel 50 and is folded so that it extends below a bottom portion of the interconnection device rearward of the latch arm 16. As best seen in FIG. 2, an edge 86 of the rearward bottom panel is disposed a short distance from the edge 76 of the forward bottom panel, thereby providing a gap between the edges 76, 86 through which the latch arm 16 can protrude. The rearward bottom panel has a lance 84, and the second side panel 60 has a rearward bottom flap 66 with an aperture 67 that receives the lance 84 in interlocking engagement.

Each of the top panel 40, the side panels 50, 60 and the rearward bottom panel 80 has a respective rear flap 48, 58, 68, 88 that encloses a portion of the cable connecting end 14 of the interconnection device. The shield also has an array of fingers 90 which are disposed at the cable connecting end 14. In a preferred embodiment the shield has four fingers 90 which are connected to the flaps 48, 58, 68, 88, respectively. Alternatively, the fingers may be connected to the panels 40, 50, 60, 80 without the flaps. The fingers are disposed in a circumferentially spaced-apart array to define a cable exit 25 between the fingers. The cable 2 which is terminated in the interconnection device 10 extends through the cable exit 25. The fingers 90 extend rearwardly to respective finger contact portions 92 which are arranged for engaging the folded-back portion of the ground sheath 6 when the cable is disposed in the cable exit. The fingers are cantilevered as they extend from the flaps, thereby giving the fingers compliancy so that a space between the fingers can be varied to accommodate a range of different size cables. A clamp or band (not shown) is preferably wrapped around the fingers in order to constrict the fingers and urge them into engagement with the cable ground sheath.

The invention provides a shielded electrical connector having several advantages. The shield is constructed as a one-piece member that reduces manufacturing and handling costs. The shield has multiple panels that substantially surround the connector, thereby minimizing EMI leakage paths through the shield. The shield has a cable exit defined by compliant fingers which are adjustable to accommodate a range of different size cables. Also, the fingers make multiple points of contact with a cable ground sheath to further improve shielding effectiveness.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

I claim:

1. A shielded electrical connector for use with a cable having a wire conductor within a ground sheath, the connector comprising:

an interconnection device having a front mating end and a rear cable-connecting end; and a conductive shield comprising a one-piece metallic member having multiple panels including top, bottom and opposite side panels disposed in respective different planes around the interconnection device, and at least four fingers disposed at the cable-connecting end of the interconnection device, each of the at least four fingers being individually coupled to a respective one of the top, bottom and opposite side panels, the at least four fingers being circumferentially spaced-apart to define a cable exit between the fingers, and the at least four fingers extending rearwardly to respective finger contact portions which are arranged for engaging the ground sheath when the cable is disposed in the cable exit.

2. The shielded electrical connector of claim 1, wherein the shield further comprises flaps which extend over the cable-connecting end, the flaps are connected to respective ones of the top, bottom and opposite side panels, and the at least four fingers are connected to respective ones of the flaps.

3. The shielded electrical connector of claim 1 wherein the at least four fingers are compliant to accommodate a range of different size cables between the fingers.

4. A shielded electrical connector for use with a cable having a wire conductor within a ground sheath, the connector comprising:

an interconnection device including a receptacle connector having a front mating face with a cavity in the mating face, the interconnection device having a rear cable-connecting end; and a conductive shield comprising a one-piece metallic member having a front panel disposed along the mating face and an opening in the front panel in registration with the cavity, multiple rearwardly extending panels including top, bottom and opposite side panels, and at least four fingers disposed at the cable-connecting end of the interconnection device, each of the at least four fingers being individually coupled to a respective one of the top, bottom and opposite side panels, the at least four fingers being circumferentially spaced-apart to define a cable exit between the fingers, and the at least four fingers extending rearwardly to respective finger contact portions which are arranged for engaging the ground sheath when the cable is disposed in the cable exit.

5. The shielded electrical connector of claim 4, wherein the shield further comprises flaps which extend over the cable-connecting end, the flaps are connected to respective ones of the top, bottom and opposite side panels, and the at least four fingers are connected to respective ones of the flaps.

6. The shielded electrical connector of claim 4 wherein the at least four fingers are compliant to accommodate a range of different size cables between the fingers.

7. A shielded electrical connector for use with a cable having a wire conductor within a ground sheath, the connector comprising:

an interconnection device including a receptacle connector having a front mating face with a cavity in the mating face, the interconnection device having a rear cable-connecting end; and a conductive shield comprising a one-piece metallic member having a front panel disposed along the mating face and an opening in the front panel in registration with the cavity, a top panel and a pair of side panels connected to the front panel, a bottom panel connected to one of the side panels, and at least four fingers disposed at the cable-connecting end in a circumferentially spaced-apart array to define a cable exit between the fingers, each of the at least four fingers being individually coupled to a respective one of the top, bottom and pair of side panels, the at least four fingers extending rearwardly to respective finger contact portions which are arranged for engaging the ground sheath when the cable is disposed in the cable exit.

8. The shielded electrical connector of claim 7, wherein the shield further comprises flaps which extend over the cable-connecting end, the flaps are connected to respective ones of the top panel, the side panels, and the bottom panel, and the at least four fingers are connected to respective ones of the flaps.

9. The shielded electrical connector of claim 7 wherein the at least four fingers are compliant to accommodate a range of different size cables between the fingers.

* * * * *